United States Patent [19]

Tomm et al.

[11] Patent Number: 4,478,284

[45] Date of Patent: Oct. 23, 1984

[54] JAR TOOL

[75] Inventors: Wayne R. Tomm, Calgary; Curt Ring, Millorville, both of Canada

[73] Assignee: Bralorne Resources Limited, Alberta, Canada

[21] Appl. No.: 352,333

[22] Filed: Feb. 25, 1982

[51] Int. Cl.[3] ..... E21B 31/113

[52] U.S. Cl. ..... 166/297; 166/299

[58] Field of Search ..... 175/296, 297, 299

[56] References Cited

U.S. PATENT DOCUMENTS

| | | | |
|---|---|---|---|
| 3,323,550 | 6/1967 | Lee | 137/809 |
| 3,340,899 | 9/1967 | Welty et al. | 138/43 |
| 3,349,858 | 10/1967 | Chenoweth | 175/297 |
| 3,851,717 | 12/1974 | Berryman | 175/297 |
| 3,949,821 | 4/1976 | Raugust | 175/297 |
| 4,076,086 | 2/1978 | Evans | 175/297 |
| 4,111,271 | 9/1978 | Perkins | 175/297 |
| 4,161,224 | 7/1979 | Hostrup | 175/297 |
| 4,196,782 | 4/1980 | Blanton | 175/297 |
| 4,284,153 | 8/1981 | Reaugh | 175/297 |

*Primary Examiner*—Stephen J. Novosad
*Assistant Examiner*—William P. Neuder
*Attorney, Agent, or Firm*—Parkhurst & Oliff

[57] ABSTRACT

A jar tool for use in a drill string for use in dislodging a drill bit or well-tools trapped in well bores. The tool comprises an outer housing adapted to move longitudinally with respect to an inner spline mandrell. A piston assembly is acted on by a piston actuator and hydraulic fluid restricts the movement of the piston assembly and, therefore, the movement of the mandrell relative to the housing, while the piston assembly is within a narrower portion of a hydraulic cylinder. When the piston assembly reaches a larger diameter portion of the cylinder, the hydraulic fluid rushes past the piston assembly which allows a knocker connected to the spline mandrell to collide with the outer housing. A compression spring returns the piston assembly to its rest position abutting a shoulder on the outer housing. Provision is made for pressure release values to be inserted in the piston assembly so that the tool can be operated within minimum and maximum operating limits.

2 Claims, 7 Drawing Figures

JAR TOOL

FIELD OF THE INVENTION

This invention relates to improvements made in jar tools used for well drilling.

BACKGROUND OF THE INVENTION

Jar tools are extensively used in the oil drilling industry to dislodge drill bits, drill string sections, or other well tools trapped in well bores. An example of such a jar tool is disclosed in U.S. Pat. No. 3,949,821 (Raugust) entitled DRILL STRING JARRING AND BUMPING TOOL WITH PISTON DISCONNECT and owned by the applicant. U.S. Pat. No. 3,949,821 discloses a jar tool which has been in satisfactory use for a number of years.

Problems have remained with the patented apparatus, however, which have resulted in improvements being made which are the subject of this application.

U.S. Pat. No. 3,949,821 discloses a jar tool having a spline mandrell and an outer housing, the mandrell and the housing being able to move longitudinally relative to each other. A knocker is connected to the mandrell and it collides with an anvil which is connected to the housing. The collision or impact between them causes the jar on the drill string and it should be appreciated that the impact is violent and the operating conditions under which the tool is used are extreme. This impact is created by the sudden release of entrapped hydraulic fluid which is allowed to rush by a piston assembly travelling from a relatively narrow diameter of a hydraulic cylinder into a relatively larger diameter where the fluid flow past the piston is largely unimpeded.

To actuate the piston assembly, a piston actuator is used. This piston actuator includes resilient fingers extending from the actuator and towards the piston. The fingers engage a resilient part on the piston assembly when contact is made and provide a "pulling" action on the piston assembly to return it to its home position following the jar. The technique of using these fingers and the necessary costs entailed in using them and complementary parts on the piston assembly is expensive and complicated.

Further, it was considered desirable to improve the metering system. The use of the metering system, required fluids that, although having viscosity characteristics more constant under different operating temperatures, did not have desirable lubricating qualities. The metering system could be improved by selecting temperature compensable valves within the metering system and pressure relief valves. The metering and pressure relief valves may be used in various combinations to achieve desirable operating characteristics.

The use of a metering system which allows for the changes in fluid viscosity and density as the temperatures within the drill hole vary, allows for the use of more desirable fluids from a lubriction view point.

SUMMARY OF THE INVENTION

According to the present invention, there is disclosed a jar tool for use in a drill string, said tool comprising: a mandrell adapted for connection to a first piece of drill pipe at one end of said tool; a housing surrounding a substantial portion of said mandrell and adapted for connection to a second piece of drill pipe at the opposite end of said tool; a first and second pair of abutment faces between said mandrell and housing defining the extended and retracted positions of said jar tool, respectively; an annular chamber between said mandrell and housing adapted to hold hydraulic fluid, said chamber being defined by a first portion having a first area, a second portion having a second area relatively larger than said first area, and a transition zone between said first and second portions; a piston assembly movable within said annular chamber from a first position within said first portion wherein fluid flow from one side of said piston to the other is substantially restricted to a second position within said second portion wherein said fluid flow is substantially unrestricted; a metering passageway in said piston assembly operable to allow passage of hydraulic fluid through said piston assembly; an actuator movable relative to said piston and having a stroke distance defined at one end by the retracted position of said jar tool, at an intermediate distance from said one end by an abutment position against said piston and at the opposite end by the extended position of said jar tool; spring means within said jar tool having a first end abutting said piston and a second end abutting said jar tool, said spring means being operable to allow piston movement relative to said second end of said spring means from said first position to said second position and to return said piston from said second position to said first position, a first pressure relief valve in said metering passageway and a second pressure relief valve positioned parallel with said first pressure relief valve, said first and second pressure relief valves being operable to define the minimum pressure to allow said piston assembly to move from said first position and to define the maximum pressure within the hydraulic fluid of said jar tool, respectively.

BRIEF DESCRIPTION OF THE DRAWINGS

An embodiment of the invention will now be described, by way of example only, with reference to the accompanying drawings in which.

DESCRIPTION OF A SPECIFIC EMBODIMENT

Figure 1:
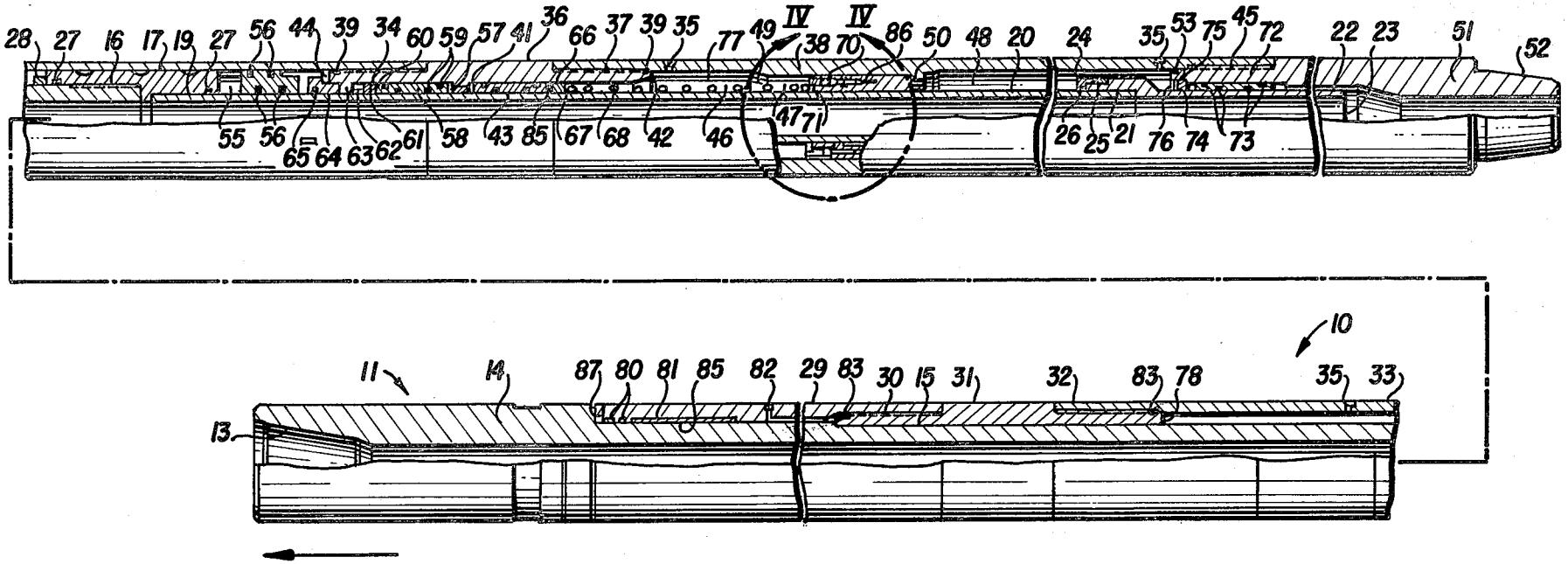
FIG. 1A is a cross-sectional view of the upper end of the jar tool in the retracted position.
FIG. 1B is a cross-sectional view of the remaining area of the jar tool continued from the right-hand end in FIG. 1A.

Referring now to FIG. 1, a jar tool is shown generally at 10. The jar tool 10 comprises a spline mandrell 11 and an outer housing 12.

Spline mandrell 11 is made up of a threaded socket 13 adapted to receive an adjacent piece of drill pipe (not shown) within the head portion 14 of the mandrell 11.

Hexagonal splines 15 extend longitudinally along mandrell 11 to threaded portion 16. A knocker 17 is connected through complementary threads at 16. Impact ring 18 is mounted between knocker 17 and shoulder 79 on spline mandrell 11. Knocker 17 has an opposed threaded end 19 and a piston mandrell 20 is threadedly connected to knocker 17 by way of threaded connection 19. Knocker 17 also includes two O-rings 27, which act as a seal between knocker 17, spline mandrell 11 and piston mandrell 20.

Mounted on an opposed threaded connection 21 of piston mandrell 20 is a washpipe 22 which extends longitudinally along the axis of jar tool 10 and terminates at end 23.

A piston actuator 24 (see also FIG. 2) is threadedly connected to complementary threads 25 on washpipe 22. An O-ring 26 acts as a seal between mandrell 20 and washpipe 22.

The outer housing 12 comprises several sections. A sealing housing 29 extends from head portion 14 of spline mandrell 11 to a threaded connection 30. The sealing housing 29 has polypak 80 acting as a seal between sealing housing 29 and head portion 14 of spline mandrell 11. Sealing housing 29 also includes bearing bushing 81 and cylinder fill plug 82 for adding hydraulic fluid to the jar tool 10. A spline housing 31 has complementary threads at 30 and, additionally, further threads 32 which are located at its opposed end. A knocker housing 33 is mounted on threads 32 and extends longitudinally from spline housing 31 to female threaded connection 34. O-rings 83 act between spline housing 31, sealing housing 29 and knocker housing 33, respectively. A cylinder fill plug 35 acts as a port for adding hydraulic fluid to the jar tool 10 in the upper chamber 55.

A packing sub 36 with complementary threaded connection 34 is connected to knocker housing 33 and it has an opposed threaded connection 37 which allows complementary threads of hydraulic cylinder 38 to be mounted thereon. Two O-rings 39 act as seals between the packing sub 36, knocker housing 33 and hydraulic cylinder 38, respectively.

Packing sub 36 has an internally formed shoulder 41 and an inner diameter which changes from a maximum area at 42 to a minimum area 43. Packing sub 36 also includes a further threaded connection 44.

Hydraulic cylinder 38 extends from the packing sub 36 to a threaded connection 45 and includes two cylinder fill plugs 35 in its periphery. The inside of hydraulic cylinder 38 is formed into three main diameters 46, 47 and 48 with a transition portion 49 existing between diameters 46 and 47. A shoulder 50 is formed between diameters 47 and 48.

Washpipe housing 51 is connected to hydraulic cylinder 38 at threaded connection 45 and extends longitudinally to threaded connection 52. An O-ring 53 acts as a seal between hydraulic cylinder 38 and washpipe housing 51.

The various apparatus which are located between the several sections of the outer housing 12 and spline mandrell 11, respectively, will now be described.

A knocker gland 54 is mounted between the knocker 17 and packing sub 36 in upper chamber 55. Knocker gland 54 contains four polypak rings 56 which act as seals between the knocker gland 54, knocker housing 33 and piston mandrell 20, respectively.

Seated against shoulder 57 of packing sub 36 is O-ring gland 58. O-ring gland 58 includes four O-rings and back up rings 59 which act between the packing sub 36 and piston mandrell 20. A female junk ring 60 abuts O-ring gland 58 and V-rings 61 are inserted between female junk ring 60 and male junk ring 62. A packing spring 63 is inserted between male junk ring 62 and upper gland nut 64. Upper gland nut 64 is threadedly connected to packing sub 36 at threaded connection 44 and includes a wiper ring 65 acting between piston mandrell 20 and upper gland nut 64.

On shoulder 41 of packing sub 36 in the area 43 between the packing sub 36 and piston mandrell 20, a second female junk ring 85 is positioned together with V-rings 66 and male junk ring 67. One end of piston return spring 68 abuts male junk ring 67 and the other is in contact with piston assembly 69.

Figure 2:
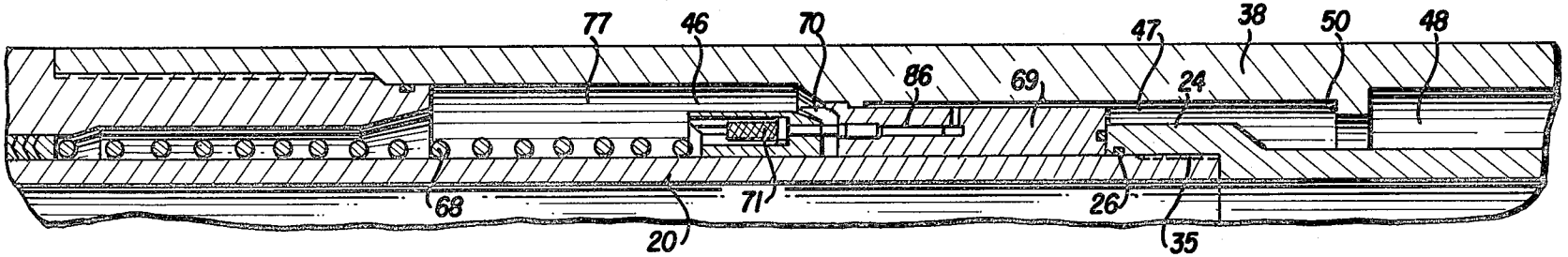
FIG. 2 is an enlarged cross-sectional view of the area IV—IV in FIG. 1B showing the piston of the jar tool just prior to entering the enlarged cylinder diameter.
Figure 3:
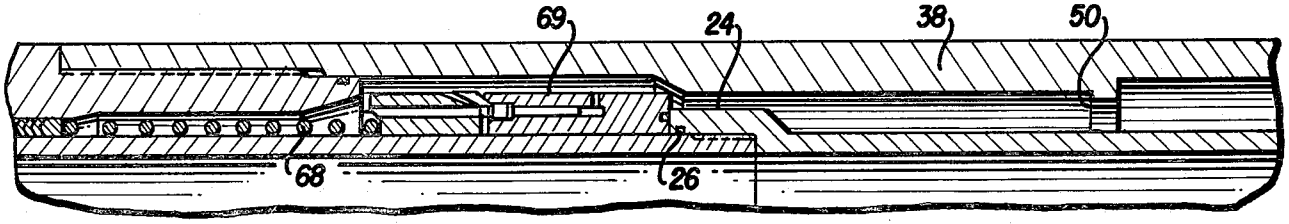
FIG. 3 is an enlarged cross-sectional view of the area IV—IV in FIG. 1B showing the piston of the jar tool following completion of the jar stroke.

Piston assembly 69 abuts shoulder 50 in hydraulic cylinder 38 in its rest position and is shown more clearly in FIGS. 2 and 3. There is a close tolerance between the piston assembly 69 and the diameter of the piston mandrell 20 and hydraulic cylinder 38. The piston assembly 69 includes a piston cup 70. The metering valve 86 is removable from the piston assembly 69 and may be replaced with other suitable valves depending on the operating conditions. Metering valves manufactured by the Lee Company, Arlington, Tex., are particularly appropriate for this type of application.

A filter cage 71 (FIG. 2) is also installed within the piston assembly 69 to remove contaminants within the hydraulic oil prior to passing through the metering and/or valve system. Piston return spring 68 retains piston assembly 69 against shoulder 50 and also acts to retain the V-rings 66, male junk ring 67 and female junk ring 85 (FIG. 1) in the positions depicted.

An O-ring gland 72 is inserted between washpipe housing 51 and washpipe 22. The O-ring gland 72 contains four O-rings and back up rings 73 which act as seals between the O-ring gland 72, washpipe housing 51 and washpipe 22, respectively. A gland nut 74 is connected to washpipe housing 51 at threaded connection 75 and a retaining ring 76 retains the gland nut 74 in position.

Figure 4:
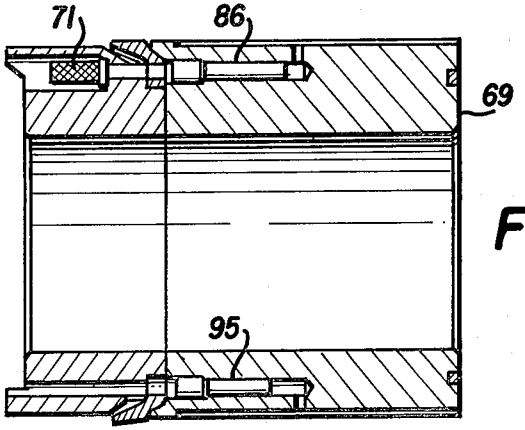
FIG. 4 is an enlarged cross-sectional view of the area IV—IV of FIG. 1B showing the relief and metering valves in a parallel configuration.

Referring now to FIG. 4, an enlarged view of the piston assembly 69 is shown in which an alternative embodiment of the invention is described. In this embodiment, the piston assembly 69 is provided with a metering valve 86 as well as a pressure relief valve 85 which is inserted in the piston assembly 69 in a configuration parallel to that of the metering valve 86.

Figure 5:
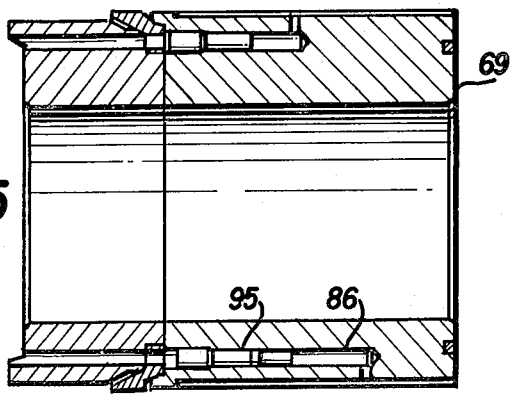
FIG. 5 is an enlarged cross-sectional view of the area IV—IV of FIG. 1B showing the relief and pressure valves in a combination parallel and series configuration.

Referring now to FIG. 5, an enlarged view of the piston assembly 69 is shown in which a further embodiment of the invention is described. In this embodiment, the piston assembly 69 is provided with a metering valve 86 and a pressure relief valve 95 in series on one side of the piston assembly 69 and with a pressure relief valve 95 only on the opposite side.

Figure 6:
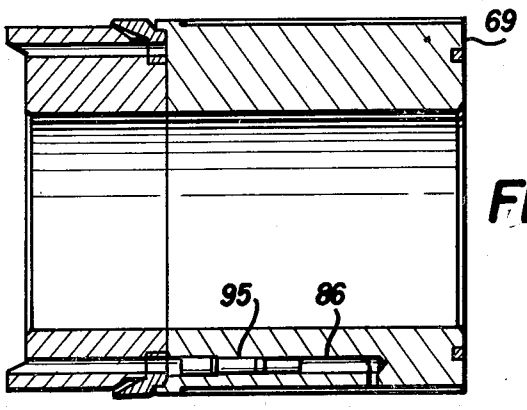
FIG. 6 is an enlarged cross-sectional view of the area IV—IV of FIG. 1B showing the relief and pressure valves in a series configuration.

Referring now to FIG. 6, an enlarged view of the piston assembly 69 is shown in which a further embodiment of the invention is described. In this embodiment, the piston assembly 69 is provided with a pressure relief valve 95 and a metering valve 86.

Figure 7:
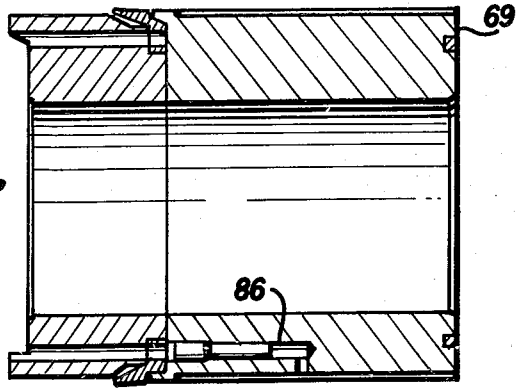
FIG. 7 is an enlarged cross-sectional view of the area IV—IV of FIG. 1B showing only a pressure relief valve configuration.

Referring now to FIG. 7, an enlarged view of the piston assembly 69 is shown in which yet a further embodiment of the invention is described. In this embodiment, the piston assembly 69 is provided with a pressure relief valve 95 only.

OPERATION

In operation, when the driller wishes to operate the jar tool, it will be assumed the tool is originally in the position shown in FIG. 1. The driller commences to apply a tension which tends to lift the drill string in the direction indicated by the arrow and, in so doing, force will be applied between the spline mandrell 11 and the outer housing 12. The head portion 14 of the spline mandrell 11 therefore, will begin to move away from sealing housing 29 at their abutting faces 87 such that cylindrical surface 85 is exposed. As spline mandrell 11 moves relative to outer housing 12, piston actuator 24 will also move leftwardly with piston mandrell 20. When piston actuator 24 contacts piston assembly 69, piston assembly 69 will move away from shoulder 50 under the influence of the piston actuator 24 as seen in FIG. 2 since the counter-acting force against piston assembly 69 by piston return spring 68 is relatively much smaller than the force from the piston actuator 24. Hydraulic cylinder 38, however, contains hydraulic fluid 77 and the oil cannot pass from area 47 of hydraulic cylinder 38 to area 48 without passing through metering valve 86. Accordingly, the relatively slow passage of hydraulic fluid 77 through metering valve 86 restricts the speed at which the spline mandrell 11 and outer housing 12 can move relative to each other until the piston assembly 69 reaches the position shown in FIG. 2. This builds up pressure within the area 46 which causes a large tensile force buildup between the two ends of the tool 10.

When the piston assembly 69, including piston cup 70 however, passes into area 46 under the continued influence of piston actuator 24, hydraulic oil 77 is free to pass around the piston assembly 69 and into areas 47 and 48 with the result that the spline mandrell 11 and outer housing 12 increase their movement relative to each other enormously. Thus, impact ring 18 on knocker 17 collides violently with impact surface 78 of spline housing 31 and this collision causes a jar or shock to the drill string. The tool assumes the condition depicted in FIG. 3.

The driller will ordinarily jar the tool several times to free the stuck drill bit or well tool and, therefore, he will now ordinarily lower the drill pipe. Piston assembly 69, under the influence of piston return spring 68, will closely follow piston actuator 24 until it returns to its rest position against shoulder 50 of hydraulic cylinder 38. Thereafter, the piston actuator may return to its rest position as depicted in FIG. 1 before a further jar is initiated by the driller.

There are many further modifications which can be made to the specific embodiment of the invention just described which changes, however, may still fall within the scope and spirit of the invention.

The embodiments of the invention in which an exclusive privilege or property is claimed is defined as follows:

1. A jar tool for use in a drill string, said tool comprising: a mandrell adapted for connection to a first piece of drill pipe at one end of said tool; a housing surrounding a substantial portion of said mandrell and adapted for connection to a second piece of drill pipe at the opposite end of said tool; a first and second pair of abutment faces between said mandrell and housing defining the extended and retracted positions of said jar tool, respectively; an annular chamber between said mandrell and housing adapted to hold hydraulic fluid, said chamber being defined by a first portion having a first area, a second portion having a second area relatively larger than said first area, and a transition zone between said first and second portions; a piston assembly movable within said annular chamber from a first position within said first portion wherein fluid flow from one side of said piston to the other is substantially restricted to a second position within said second portion wherein said fluid flow is substantially unrestricted; a metering passageway in said piston assembly operable to allow passage of hydraulic fluid through said piston assembly; an actuator movable relative to said piston and having a stroke distance defined at one end by the retracted position of said jar tool, at an intermediate distance from said one end by an abutment position against said piston and at the opposite end by the extended position of said jar tool; spring means within said jar tool having a first end abutting said piston and a second end abutting said jar tool, said spring means being operable to allow piston movement relative to said second end of said spring means from said first position to said second position and to return said piston from said second position to said first position, a first pressure relief valve in said metering passageway and a second pressure relief valve positioned parallel with said first pressure relief valve, said first and second pressure relief valves being operable to define the minimum pressure to allow said piston assembly to move from said first position and to define the maximum pressure within the hydraulic fluid of said jar tool, respectively.

2. A jar tool for use in a drill string, said tool comprising: a mandrell adapted for connection to a first piece of drill pipe at one end of said tool; a housing surrounding a substantial portion of said mandrell and adapted for connection to a second piece of drill pipe at the opposite end of said tool; a first and second pair of abutment faces between said mandrell and housing defining the extended and retracted positions of said jar tool, respectively; an annular chamber between said mandrell and housing adapted to hold hydraulic fluid, said chamber being defined by a first portion having a first area, a second portion having a second area relatively larger than said first area, and a transition zone between said first and second portions; a piston assembly extending between said mandrell and said housing and forming a seal in said annular chamber between the opposed faces of said piston assembly in a first position within said annular chamber, said piston assembly being movable from said first position within said first portion wherein fluid flow from one side of said piston to the other is substantially restricted to a second position within said second portion wherein said fluid flow is substantially unrestricted; a metering passageway in said piston assembly operable to allow passage of hydraulic fluid through said piston assembly; an actuator movable relative to said piston and having a stroke distance defined at one end by the retracted position of said jar tool, at an intermediate distance from said one end by an abutment position against said piston and at the opposite end by the extended position of said jar tool; spring means within said jar tool having a first end abutting said piston and a second end abutting said jar tool, said spring means being operable to allow piston movement relative to said second end of said spring means from said first position to said second position and to return said piston from said second position to said first position, a first pressure relief valve in said metering passageway and a second pressure relief valve positioned parallel with said first pressure relief valve, said first and second pressure relief valves being operable to define the minimum pressure to allow said piston assembly to move from said first position and to define the maximum pressure within the hydraulic fluid of said jar tool, respectively.

* * * * *